US012435727B2

(12) United States Patent
Miny

(10) Patent No.: US 12,435,727 B2
(45) Date of Patent: Oct. 7, 2025

(54) ROTOR STRUCTURE AND METHODOLOGY FOR ASSEMBLY OR DISASSEMBLY OF SUCH ROTOR STRUCTURE

(71) Applicant: Siemens Energy Global GmbH & Co. KG

(72) Inventor: Kevin Miny, Essen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/840,953

(22) PCT Filed: Apr. 15, 2022

(86) PCT No.: PCT/US2022/025020
§ 371 (c)(1),
(2) Date: Aug. 23, 2024

(87) PCT Pub. No.: WO2023/200454
PCT Pub. Date: Oct. 19, 2023

(65) Prior Publication Data

US 2025/0163927 A1 May 22, 2025

(51) Int. Cl.
*F04D 29/054* (2006.01)
*F04D 17/10* (2006.01)
*F04D 29/62* (2006.01)

(52) U.S. Cl.
CPC ..... *F04D 29/054* (2013.01); *F04D 17/10* (2013.01); *F04D 29/624* (2013.01)

(58) Field of Classification Search
CPC .... F04D 17/122; F04D 29/0405; F04D 29/05; F04D 29/054
See application file for complete search history.

(56) References Cited

U.S. PATENT DOCUMENTS 8,967,960 B2 * 3/2015 Guenard ..... F04D 29/054 415/198.1
10,718,212 B2 * 7/2020 Jahrmarcht ..... F01D 5/026
11,959,485 B2 * 4/2024 Kuzdzal ..... F04D 29/054

FOREIGN PATENT DOCUMENTS

JP 6726618 B2 7/2020
WO 2021230869 A1 11/2021

OTHER PUBLICATIONS

PCT International Search Report and Written Opinion of International Searching Authority mailed Dec. 14, 2022 corresponding to PCT International Application No. PCT/US2022/025020 filed Apr. 15, 2022.

* cited by examiner

*Primary Examiner* — Danielle M. Christensen
(74) *Attorney, Agent, or Firm* — Enrique J. Mora

(57) ABSTRACT

Turbomachine and method for assembling/disassembling a rotor structure of the turbomachine are disclosed. A plurality of impeller bodies is supported on a tie bolt. Threadingly connecting a first coupling nut with the tie bolt to axially press the impeller bodies to define a compression section. The first coupling nut is arranged to apply a first coupling force within the compression section to hold the compression section attached during rotating operation of the turbomachine. Threadingly connecting a second coupling nut with the tie bolt to axially press a rotor shaft portion onto the compression section. The second coupling nut is arranged to apply a second coupling force to the rotor shaft portion to hold the rotor shaft portion affixed onto the compression section during a non-rotating condition of the turbomachine. The foregoing multi-nut coupling arrangement in a cost-effective and reliable manner provides user-friendly flexibility for assembly/disassembly of the rotor structure while maintaining a mechanically robust rotor structure.

17 Claims, 4 Drawing Sheets

ROTOR STRUCTURE AND METHODOLOGY FOR ASSEMBLY OR DISASSEMBLY OF SUCH ROTOR STRUCTURE

BACKGROUND

Disclosed embodiments relate generally to the field of turbomachinery, and, more particularly, to a rotor structure for a turbomachine, and methodology for assembly or disassembly of such rotor structure.

Turbomachinery is used extensively in the oil and gas industry, such as for performing compression of a process fluid, conversion of thermal energy into mechanical energy, fluid liquefaction, etc. One example of such turbomachinery is a compressor, such as a centrifugal compressor.

SUMMARY

In one aspect, a method for assembling and disassembling a rotor structure in a turbomachine is disclosed. A plurality of impeller bodies is supported on a tie bolt. Threadingly connecting a first coupling nut with the tie bolt to axially press the plurality of impeller bodies to define a compression section of the turbomachine. The connecting of the first coupling nut is arranged to apply a first coupling force within the compression section to hold the compression section of the turbomachine attached during rotating operation of the turbomachine. A rotor shaft portion is positioned adjacent the compressor section. Threadingly connecting a second coupling nut with the tie bolt to axially press the rotor shaft portion onto the compression section. The connecting of the second coupling nut on the tie rod is arranged to apply a second coupling force to the rotor shaft portion to hold the rotor shaft portion affixed onto the compression section during a non-rotating condition of the turbomachine.

In another aspect, a turbomachine is disclosed. The turbomachine includes a plurality of impeller bodies stacked adjacent one another on the tie bolt. A first coupling nut is threadingly connected with the tie bolt to axially press the plurality of impeller bodies to define a compression section of the turbomachine. The first coupling nut is arranged to apply a first coupling force within the compression section to hold the compression section of the compressor affixed during rotating operation of the turbomachine. A rotor shaft portion is positioned adjacent the compressor section. A second coupling nut is threadingly connected with the tie bolt to axially press the rotor shaft portion onto the compression section, wherein the second coupling nut is arranged to apply a second coupling force to the rotor shaft portion, wherein the second coupling force is smaller than the first coupling force to hold the rotor shaft portion affixed onto the compression section during a non-rotating condition of the turbomachine The foregoing has broadly outlined some of the technical features of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Also, before undertaking the Detailed Description below, it should be understood that various definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
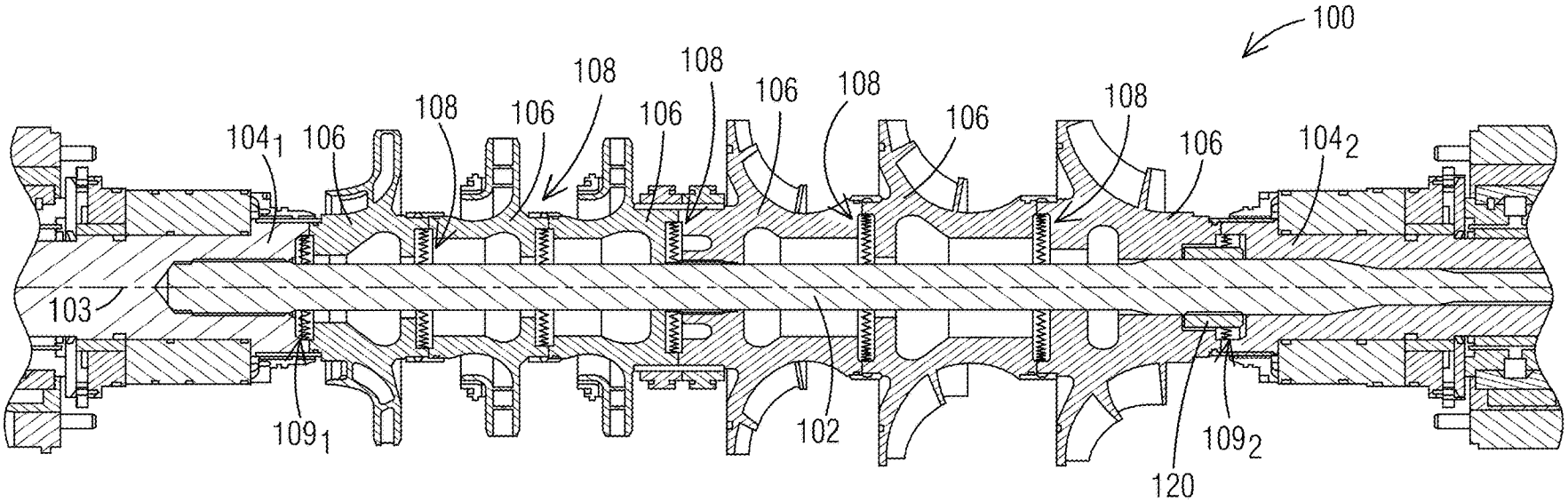
FIG. 1 illustrates a fragmentary cross-sectional view of one non-limiting embodiment of a rotor structure, as may be used in industrial applications involving turbomachinery, such as without limitation, compressors (e.g., centrifugal compressors, etc.).

As would be appreciated by those skilled in the art, turbomachinery, such as centrifugal compressors, may involve rotors of tie bolt construction (also referred to in the art as thru bolt or tie rod construction). The tie bolt is arranged to support a plurality of impeller bodies that, for example, in combination may form a compressor section of the compressor. Adjacent impeller bodies may be interconnected to one another by way of elastically averaged coupling techniques, such as involving Hirth couplings or curvic couplings. These coupling types use different forms of face gear teeth (straight and curved, respectively) to form a robust coupling between adjacent components.

The inventor of the present invention has recognized that in certain known rotor designs involving a tie bolt, such as where the entire length of the tie bolt may be stretched by a hydraulic device to develop a relatively large coupling force, as may involve a locking nut located at an end of the tie bolt, costly and burdensome operations may be involved before certain components of a given turbomachine can be accessed and replaced. For example, untightening of the locking nut during disassembly may involve for reassembly to once again stretching the entire length of the tie bolt by the hydraulic tool, which is a time-consuming process. Disclosed embodiments make use of a multi-nut coupling arrangement that is effective to appropriately distribute clamping loads along certain portions of the tie bolt.

In disclosed embodiments, for example, one of the coupling nuts may be arranged to provide a coupling (e.g., clamping) force within the compressor section appropriate to hold the impeller bodies of the turbomachine attached during rotating operation of the turbomachine. That is, appropriate to handle all rotation related and thermal transient effects expected to develop during operation of the turbomachine. Another of the coupling nuts may be arranged to provide a clamping force appropriate to hold just a rotor shaft portion during a non-rotating condition of the turbomachine. That is, appropriate to handle static loads that may act on such rotor shaft portion and may advantageously permit assembly/disassembly of certain components of the turbomachine without unloading the coupling force within the compression section. Disclosed embodiments in a cost-effective and reliable manner provide improved flexibility for assembly/disassembly of the rotor structure while maintaining a mechanically robust rotor structure.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

It should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates a fragmentary cross-sectional view of one non-limiting embodiment of a disclosed rotor structure 100, as may be used in industrial applications involving turbomachinery, such as without limitation, compressors (e.g., centrifugal compressors, etc.).

In one disclosed embodiment, a tie bolt 102 extends along a rotor axis 103 between opposite ends of the tie bolt 102. A plurality of impeller bodies 106 may be disposed between rotor shaft portions $\mathbf{104}_1$, $\mathbf{104}_2$, where the impeller bodies 106 are stacked adjacent one another and supported by the tie bolt 102 to, for example, define a compressor section. In the illustrated embodiment, the number of impeller bodies is six; it will be appreciated that this is just one example and should not be construed in a limiting sense regarding the number of impeller bodies that may be used in disclosed embodiments. The embodiment illustrated in FIG. 1 involves a center-hung configuration of back-to-back impeller stages; once again it will be appreciated that this is just one example configuration and should not be construed in a limiting sense regarding the applicability of disclosed embodiments.

The plurality of impeller bodies 106 is mechanically coupled to one another along rotor axis 103 by way of a plurality of hirth couplings 108. In the illustrated embodiment, since as noted above, the number of impeller bodies is six, then the number of hirth couplings between adjoining impeller bodies 106 would be five. It will be appreciated that two additional hirth couplings $\mathbf{109}_1$ and $\mathbf{109}_2$ may be used to couple the impeller bodies respectively with respectively abutting rotor shaft portions $\mathbf{104}_1$, $\mathbf{104}_2$. It will be appreciated that the foregoing arrangement of impeller bodies and hirth couplings is just one example and should not be construed in a limiting sense.

Figure 2:
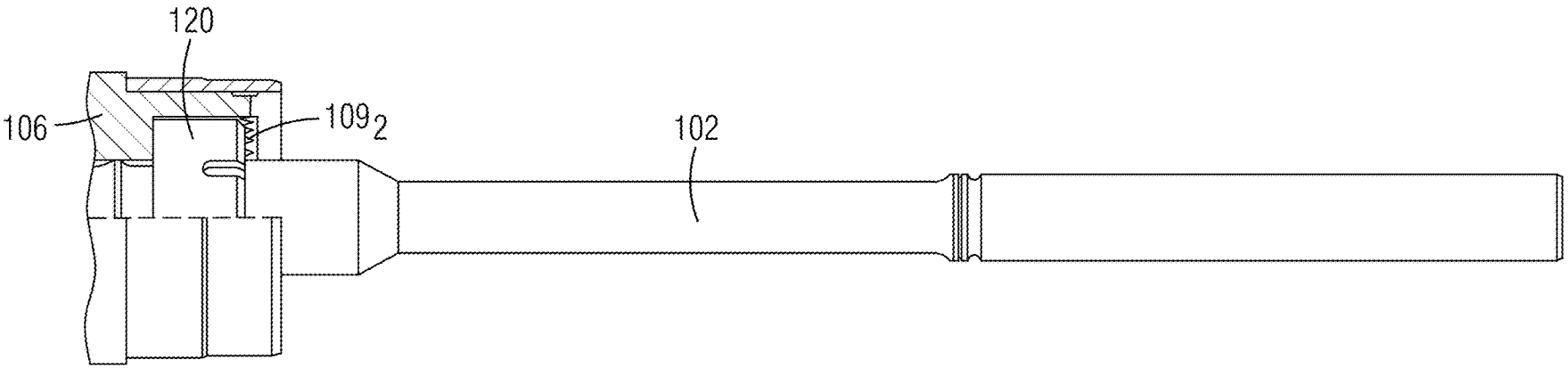
FIG. 2 and FIG. 3 are fragmentary cross-sectional views respectively illustrating certain assembly acts involving a multi-nut arrangement for coupling respective rotor shaft portions in one example embodiment of a disclosed rotor structure.

FIG. 2 is a fragmentary cross-sectional view illustrating assembly of a first coupling nut 120 of a multi-nut arrangement with the tie bolt 102. As may be better appreciated in FIG. 2, first coupling nut 120 is threadingly connected with tie bolt 102 to axially press the plurality of impeller bodies 106 to define the compression section of the turbomachine. In one embodiment, first coupling nut 120 is arranged to apply a first coupling force within the compression section to hold the compression section of the compressor affixed during rotating operation of the turbomachine.

Figure 3:
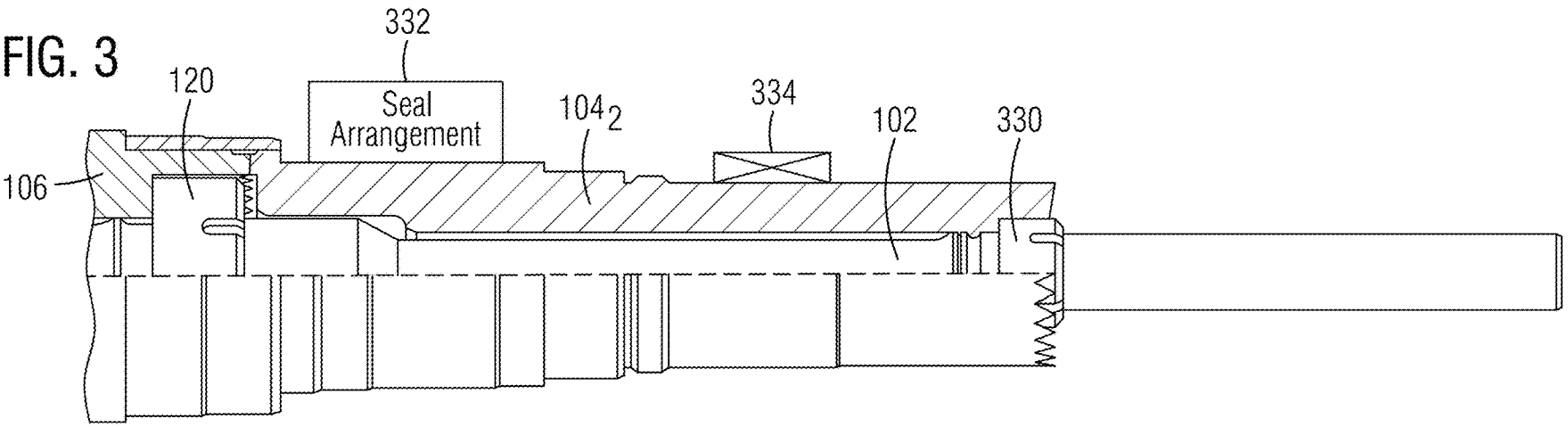

FIG. 3 is a fragmentary cross-sectional view illustrating assembly of a second coupling nut 330 of the multi-nut arrangement with the tie bolt 102. As shown in FIG. 3, second coupling nut 330 is threadingly connected with tie bolt 102 to axially press rotor shaft portion $\mathbf{104}_2$ onto the compression section. In one embodiment, second coupling nut 330 is arranged to apply a second coupling force to rotor shaft portion $\mathbf{104}_2$. In one embodiment, the second coupling force is smaller than the first coupling force, and the magnitude of this second force may be chosen to hold rotor shaft portion rotor $\mathbf{104}_2$ affixed onto the compression section during a non-rotating condition of the turbomachine. Although the drawings are not intended to precisely establish a dimensional scale for the elements shown therein, one can readily appreciate that the size of second coupling nut 330 is smaller relative to the size of first coupling nut 120 and this is consistent with the disclosure above that the second coupling force provided by second coupling nut 330 is smaller than the first coupling force provided by first coupling nut 120.

Figure 5:
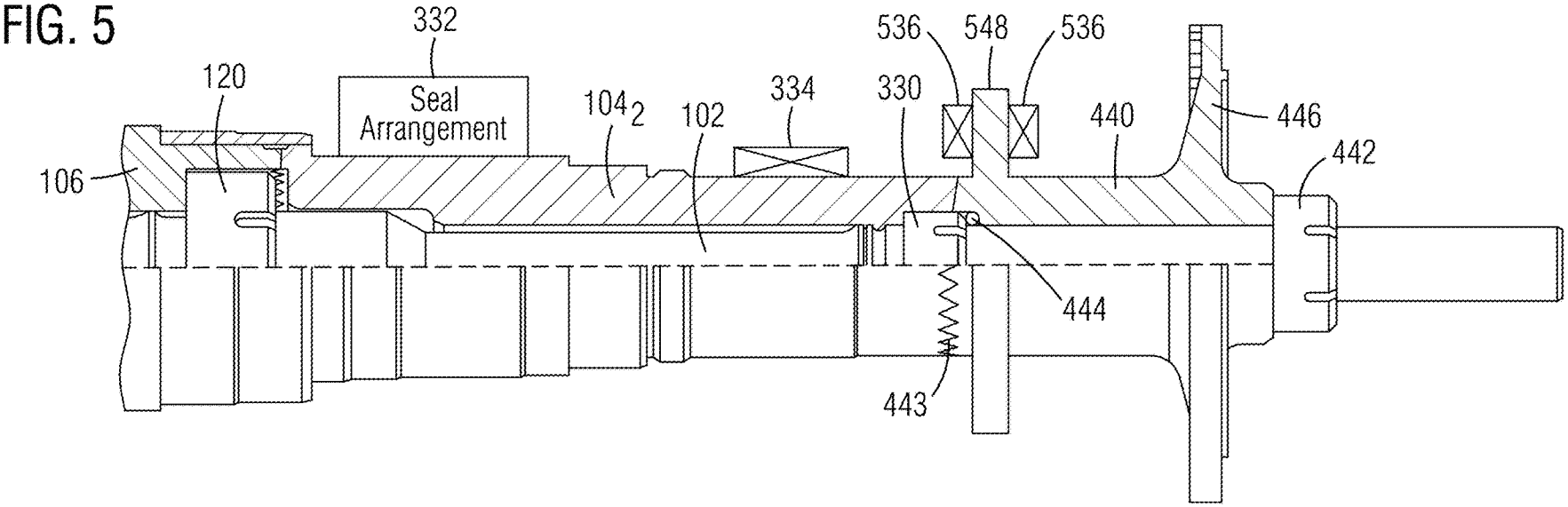
FIG. 5 is a fragmentary cross-sectional view illustrating the multi-nut arrangement in an assembled condition in another example embodiment of a disclosed rotor structure.

In one example embodiment, after threadingly connecting second coupling nut 330 on tie bolt 102, one can assemble at least one component of the turbomachine rotor about rotor shaft portion $\mathbf{104}_2$, and the assembling of the at least one component may be carried out without unloading the coupling force within the compression section. Examples of the at least one component may be a seal arrangement 332, a bearing arrangement, as may include a journal bearing 334, and a thrust bearing 536 (FIG. 5).

Figure 4:
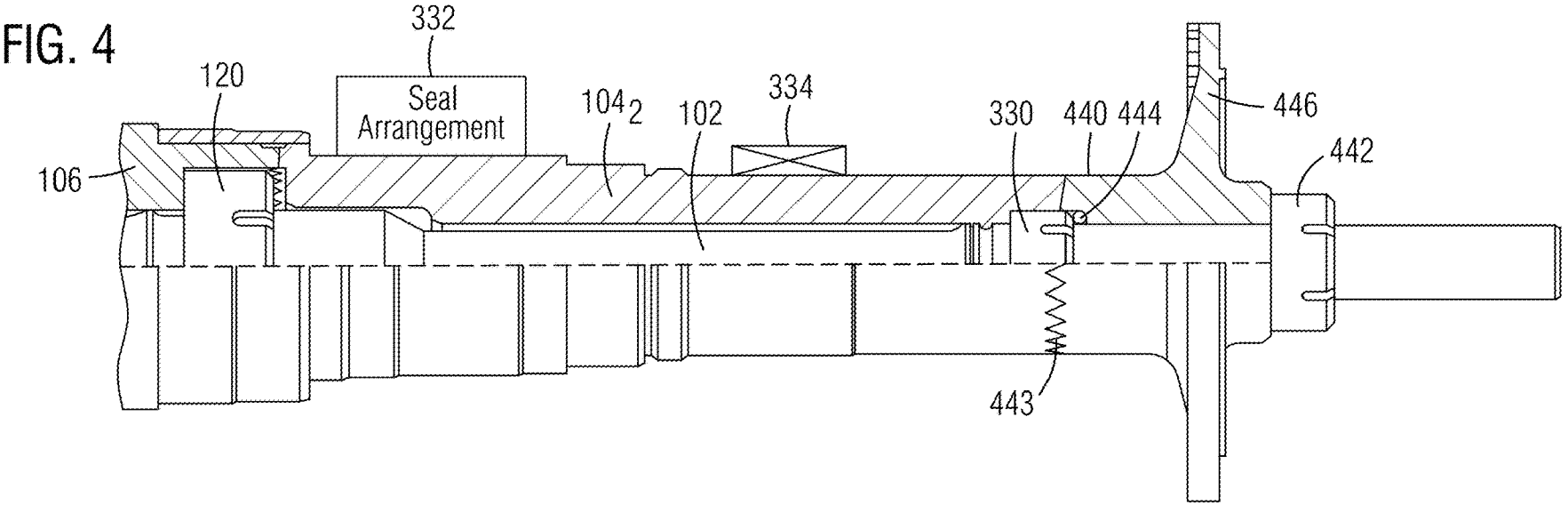
FIG. 4 is a fragmentary cross-sectional view illustrating the multi-nut arrangement in an assembled condition in the example embodiment illustrated in FIGS. 2 and 3.

FIG. 4 is a fragmentary cross-sectional view illustrating assembly of a third coupling nut 442 of the multi-nut arrangement with the tie bolt 102. As shown in FIG. 4, a rotor shaft end 440 is positioned adjacent rotor shaft portion $\mathbf{104}_2$, and a third coupling nut 442 is threadingly connected with tie bolt 102 to apply a third coupling force on the rotor shaft end to hold rotor shaft end 440 and rotor shaft portion $\mathbf{104}_2$ affixed to the compressor section during rotating operation of the turbomachine. In one embodiment, a Hirth joint 443 is used to axially couple the rotor shaft portion $\mathbf{104}_2$ and the rotor shaft end 440.

In one embodiment, an O-ring 444 is disposed in a circumferentially-extending groove in rotor shaft end 440. O-ring 444 is positioned to circumferentially abut against a head of second coupling nut 330 and frictionally engage second coupling nut to hold the second coupling nut 330 in place. For example, as third coupling nut 442 is tightened and the loading on second coupling nut 330 is reduced, then O-ring 444 would inhibit rotation of second coupling nut 330.

Figure 6:
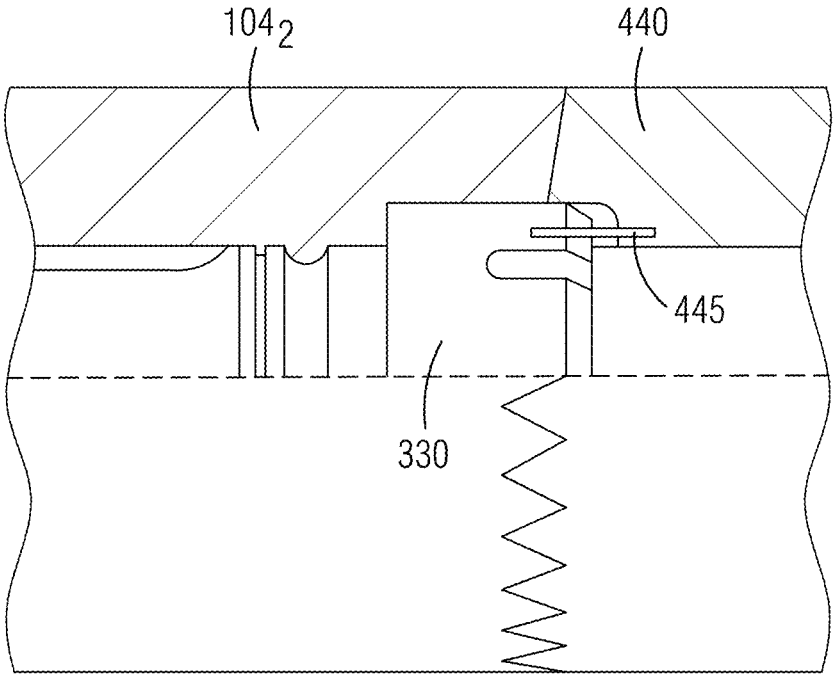
FIG. 6 and FIG. 7 are respective fragmentary cross-sectional sectional views showing alternative embodiments to inhibit movement of a second nut of the multi-nut arrangement.
Figure 7:
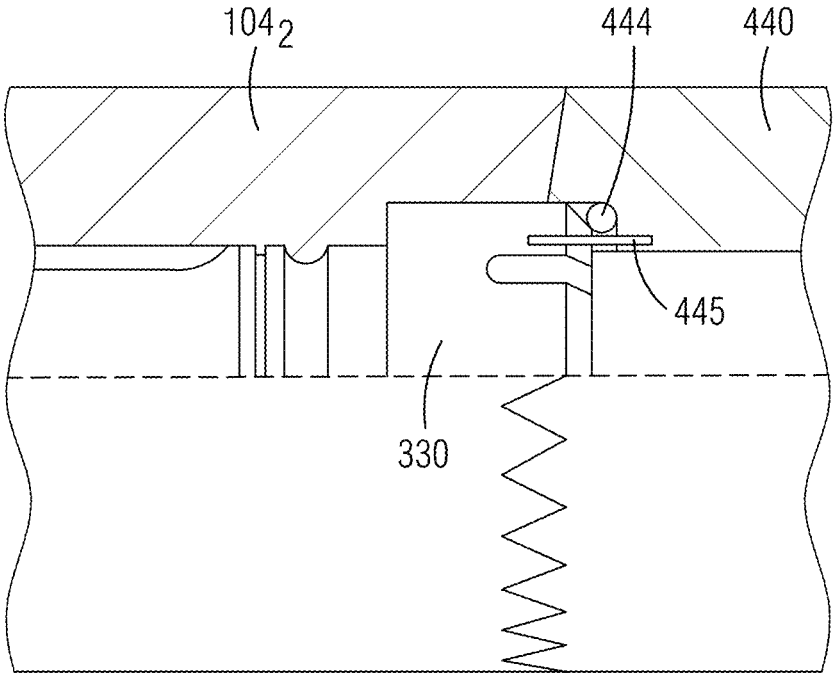

In one alternative embodiment, as shown in FIG. 6, a retaining dowel 445 (e.g., a dowel pin that may be made of stainless steel, other alloy steels or similar,) may be used in lieu of O-ring 444 to inhibit rotation of the second coupling nut 330. Retaining dowel 445 may be press fit into the rotor shaft, e.g., rotor shaft end 440, to engage a corresponding slot in the second coupling nut 330. In another embodiment as shown in FIG. 7, one may use a combination of O-ring 444 and retaining dowel 445 to inhibit rotation of the second coupling nut 330. It will be appreciated that the rotation-inhibiting (e.g., retention) functionality provided by O-ring 444 and/or retaining dowel 445 to the second coupling nut 330 would also apply during rotating operation of the turbomachine.

In one disclosed embodiment, as shown in FIG. 4, a radially-extending coupling flange 446 is located adjacent a first axial edge of rotor shaft end 440 and the coupling flange 446 is integrally constructed to form one-piece with rotor shaft end 440. In another disclosed embodiment, in addition to the radially-extending coupling flange 446, a thrust disc 548 (FIG. 5) is located adjacent a second axial edge the rotor shaft end. In this embodiment, radially-extending coupling flange 446 and thrust disc 548 are integrally constructed to form one-piece with rotor shaft end 440. In one non-limiting embodiment, tie bolt 102 has equal diameter at the respective locations where the second coupling nut 330 and the third coupling nut 442 are respectively threadingly connected with the tie bolt 102.

In operation, disclosed embodiments in a cost-effective and reliable manner provide improved flexibility for assembly/disassembly of the rotor structure of a turbomachine while maintaining a mechanically robust rotor structure. For example, disclosed enable assembly/disassembly of certain components of the turbomachine without unloading the coupling force within the compression section. That is, certain components of the turbomachine located at or proximate rotor shaft portion $\mathbf{104}_2$ can be accessed and replaced in a user-friendly manner, such as without having to extract the entire rotor assembly from the compressor casing and re-stretching the entire length of the tie bolt by a hydraulic device.

In operation, disclosed embodiments enable user-friendly serviceability of components such as seal arrangement 332, and bearing arrangements 334, 536 by way of disassembly of the rotor shaft end 440, without having to extract the entire rotor assembly from the compressor casing. Additionally, disclosed embodiments enable, the coupling flange 446 and/or the thrust disc 548 to be integrally constructed to form one-piece with rotor shaft end 440 while preserving the foregoing user-friendly serviceability.

Although at least one exemplary embodiment of the present disclosure has been described in detail, those skilled in the art will understand that various changes, substitutions, variations, and improvements disclosed herein may be made without departing from the scope of the disclosure in its broadest form.

None of the description in the present application should be read as implying that any particular element, step, act, or function is an essential element, which must be included in the claim scope. The scope of patented subject matter is defined only by the allowed claims. Moreover, none of these claims are intended to invoke a means plus function claim construction unless the exact words "means for" are followed by a participle.

What is claimed is:

1. A method for assembling and disassembling a rotor structure in a turbomachine, the method comprising:

supporting a plurality of impeller bodies on a tie bolt;

threadingly connecting a first coupling nut with the tie bolt to axially press the plurality of impeller bodies to define a compression section of the turbomachine, wherein the threadingly connecting of the first coupling nut is arranged to apply a first coupling force within the compression section to hold the compression section of the turbomachine attached during rotating operation of the turbomachine;

positioning a rotor shaft portion adjacent the compression section;

threadingly connecting a second coupling nut with the tie bolt to axially press the rotor shaft portion onto the compression section, wherein the threadingly connecting of the second coupling nut on the tie rod is arranged to apply a second coupling force to the rotor shaft portion to hold the rotor shaft portion affixed onto the compression section during a non-rotating condition of the turbomachine;

after threadingly connecting the second coupling nut on the tie bolt, assembling at least one component of the turbomachine about the rotor shaft portion, wherein the assembling is carried out without unloading the first coupling force within the compression section; and disposing an O-ring in a circumferentially-extending groove in a rotor shaft end, the O-ring positioned to circumferentially abut against a head of the second coupling nut.

2. The method of claim 1, threadably connecting a third coupling nut with the tie rod to axially press the rotor shaft end onto the rotor shaft portion, wherein the threadingly connecting of the third coupling nut on the tie rod is arranged to apply a third coupling force on the rotor shaft end to hold the rotor shaft end and the rotor shaft portion affixed to the compressor section during the rotating operation of the turbomachine, after the assembling of the at least one component of the turbomachine.

3. The method of claim 2, further comprising threadingly disconnecting the third coupling nut to axially separate the rotor shaft end from the rotor shaft portion.

4. The method of claim 3, further comprising carrying out disassembly from the rotor shaft portion of the least one component of the turbomachine without unloading the first coupling force within the compression section.

5. The method of claim 1, wherein the first coupling force is larger than the second coupling force.

6. The method of claim 5, wherein the O-ring frictionally engages the second coupling nut to hold the second coupling nut in place.

7. The method of claim 1, wherein the turbomachine is a centrifugal compressor.

8. The method of claim 5, wherein the at least one component of the turbomachine being assembled about the rotor shaft portion comprises at least one of a seal arrangement and a bearing arrangement.

9. A turbomachine comprising:

a tie bolt;

a plurality of impeller bodies stacked adjacent one another on the tie bolt;

a first coupling nut threadingly connected with the tie bolt to axially press the plurality of impeller bodies to define a compression section of the turbomachine, wherein the first coupling nut is arranged to apply a first coupling force within the compression section to hold the compression section of the turbomachine affixed during rotating operation of the turbomachine;

a rotor shaft portion adjacent the compression section;

a second coupling nut threadingly connected with the tie bolt to axially press the rotor shaft portion onto the compression section, wherein the second coupling nut is arranged to apply a second coupling force to the rotor shaft portion, wherein the second coupling force is smaller than the first coupling force to hold the rotor shaft portion affixed onto the compression section during a non-rotating condition of the turbomachine;

at least one component of the turbomachine being assembled about the rotor shaft portion during the non-rotating condition of the turbomachine without unloading the first coupling force within the compression section, a rotor shaft end adjacent the rotor shaft portion;

a third coupling nut threadingly connected with the tie bolt to apply a third coupling force on the rotor shaft end to hold the rotor shaft end and the rotor shaft portion affixed to the compression section during rotating operation of the turbomachine; and an O-ring disposed in a circumferentially-extending groove in the rotor shaft end, the O-ring positioned to circumferentially abut against a head of the second coupling nut, wherein the O-ring is arranged to frictionally engage the second coupling nut and hold the second coupling nut in place.

10. The turbomachine of claim 9, further comprising a radially-extending coupling flange integrally constructed to form one-piece with the rotor shaft end.

11. The turbomachine of claim 9, further comprising a radially-extending coupling flange located adjacent a first axial edge of the rotor shaft end, and further comprising a thrust disc located adjacent a second axial edge of the rotor shaft end, the radially-extending coupling flange and the thrust disc integrally constructed to form one-piece with the rotor shaft end.

12. The turbomachine of claim 9, wherein the at least one component of the turbomachine assembled about the rotor shaft portion comprises at least one of a seal arrangement and a bearing arrangement.

13. The turbomachine of claim 9, further comprising a Hirth joint to axially couple the rotor shaft portion and the rotor shaft end.

14. A turbomachine comprising:

a tie bolt;

a plurality of impeller bodies stacked adjacent one another on the tie bolt;

a first coupling nut threadingly connected with the tie bolt to axially press the plurality of impeller bodies to define a compression section of the turbomachine, wherein the first coupling nut is arranged to apply a first coupling force within the compression section to hold the compression section of the turbomachine affixed during rotating operation of the turbomachine;

a rotor shaft portion adjacent the compression section;

a second coupling nut threadingly connected with the tie bolt to axially press the rotor shaft portion onto the compression section, wherein the second coupling nut is arranged to apply a second coupling force to the rotor shaft portion, wherein the second coupling force is smaller than the first coupling force to hold the rotor shaft portion affixed onto the compression section during a non-rotating condition of the turbomachine; and a dowel pin positioned to engage the second coupling nut and hold the second coupling nut in place.

15. A turbomachine comprising:

a tie bolt;

a plurality of impeller bodies stacked adjacent one another on the tie bolt;

a first coupling nut threadingly connected with the tie bolt to axially press the plurality of impeller bodies to define a compression section of the turbomachine, wherein the first coupling nut is arranged to apply a first coupling force within the compression section to hold the compression section of the compression affixed during rotating operation of the turbomachine;

a rotor shaft portion adjacent the compression section;

a second coupling nut threadingly connected with the tie bolt to axially press the rotor shaft portion onto the compression section, wherein the second coupling nut is arranged to apply a second coupling force to the rotor shaft portion, wherein the second coupling force is smaller than the first coupling force to hold the rotor shaft portion affixed onto the compression section during a non-rotating condition of the turbomachine; and a dowel pin and an O-ring each positioned to respectively engage the second coupling nut and hold the second coupling nut in place.

16. The turbomachine of claim 15, wherein the turbomachine is a centrifugal compressor.

17. A turbomachine comprising:

a tie bolt;

a plurality of impeller bodies stacked adjacent one another on the tie bolt;

a first coupling nut threadingly connected with the tie bolt to axially press the plurality of impeller bodies to define a compression section of the turbomachine, wherein the first coupling nut is arranged to apply a first coupling force within the compression section to hold the compression section of the turbomachine affixed during rotating operation of the turbomachine;

a rotor shaft portion adjacent the compression section; and a second coupling nut threadingly connected with the tie bolt to axially press the rotor shaft portion onto the compression section, wherein the second coupling nut is arranged to apply a second coupling force to the rotor shaft portion, wherein the second coupling force is smaller than the first coupling force to hold the rotor shaft portion affixed onto the compression section, a rotor shaft end adjacent the rotor shaft portion; a third coupling nut threadingly connected with the tie bolt to apply a third coupling force on the rotor shaft end to hold the rotor shaft end and the rotor shaft portion affixed to the compression section during rotating operation of the turbomachine;

wherein the tie bolt has equal diameter at the respective locations where the second coupling nut and the third coupling nut are respectively threadingly connected with the tie bolt.

* * * * *